US006224530B1

(12) United States Patent
Okelmann et al.

(10) Patent No.: US 6,224,530 B1
(45) Date of Patent: May 1, 2001

(54) BUCKLE FOLDING MECHANISM WITH TWO OR THREE FOLDING POCKETS

(75) Inventors: Walter Okelmann, Augsberg; Helmut Jörg, Neusaess, both of (DE)

(73) Assignee: Boewe Systec AG, Augsburg (DE)

( * ) Notice: Subject to any disclaimer, the term of this patent is extended or adjusted under 35 U.S.C. 154(b) by 0 days.

(21) Appl. No.: 09/308,849

(22) PCT Filed: Jan. 22, 1998

(86) PCT No.: PCT/DE98/00206

§ 371 Date: May 24, 1999

§ 102(e) Date: May 24, 1999

(87) PCT Pub. No.: WO98/40300

PCT Pub. Date: Sep. 17, 1998

(30) Foreign Application Priority Data

Mar. 8, 1997 (DE) ..... 197 09 643

(51) Int. Cl.[7] ..... B31F 1/00

(52) U.S. Cl. ..... 493/420; 493/476; 493/478; 493/479

(58) Field of Search ..... 493/420, 419, 493/422, 475, 476, 478, 479, 421

(56) References Cited

U.S. PATENT DOCUMENTS

| | | | | |
|---|---|---|---|---|
| 4,565,046 | * | 1/1986 | Stumpf | 493/475 |
| 5,246,415 | * | 9/1993 | Fuss | 493/420 |
| 5,263,708 | * | 11/1993 | Hacknauer | 493/420 |
| 5,514,066 | * | 5/1996 | Monaco | 493/420 |
| 5,683,338 | * | 11/1997 | Krasuski et al. | 493/420 |
| 5,697,880 | * | 12/1997 | Auerbach | 493/420 |
| 5,967,963 | * | 10/1999 | Gotting | 493/476 |

FOREIGN PATENT DOCUMENTS

| | | |
|---|---|---|
| 517 549 | 1/1931 | (DE) . |
| 730 387 | 12/1942 | (DE) . |
| 24 59 294 | 8/1975 | (DE) . |

* cited by examiner

*Primary Examiner*—Eugene Kim
(74) *Attorney, Agent, or Firm*—Flynn, Thiel, Boutell & Tanis, P.C.

(57) ABSTRACT

A buckle folder machine includes two or three folder pockets and several folding rollers mounted in a folding block which can be detached from the machine frame. The sheets are fed to the folding block via transport devices along an input plane in the direction of travel of the paper and delivered along an output plane in the same direction. The input plane and output plane are situated on substantially the same plane. The folding rollers and machine pockets are arranged in the folding block in such a way that the sheet input and sheet output are also situated in the area of this common plane in line with the position in which the folding block is mounted inside the machine frame. All folding rollers are connected to each other in the folding block via coupling gear wheels positioned on either end of each folding roller. The drive mechanism is located in the machine frame and in the area of the folding block has a drive gear positioned in same machine frame which in a first mounting position of the folding block meshes with one of the coupling gear wheels. One of the folding rollers has a driven gear at its other end which meshes with the drive gear in a second mounting position of the folding block in which said block is inserted into the machine frame in such a way that it is turned 180° in relation to its first mounting position around an imaginary axis extending parallel in the direction of travel of the paper.

11 Claims, 6 Drawing Sheets

FIG. 4
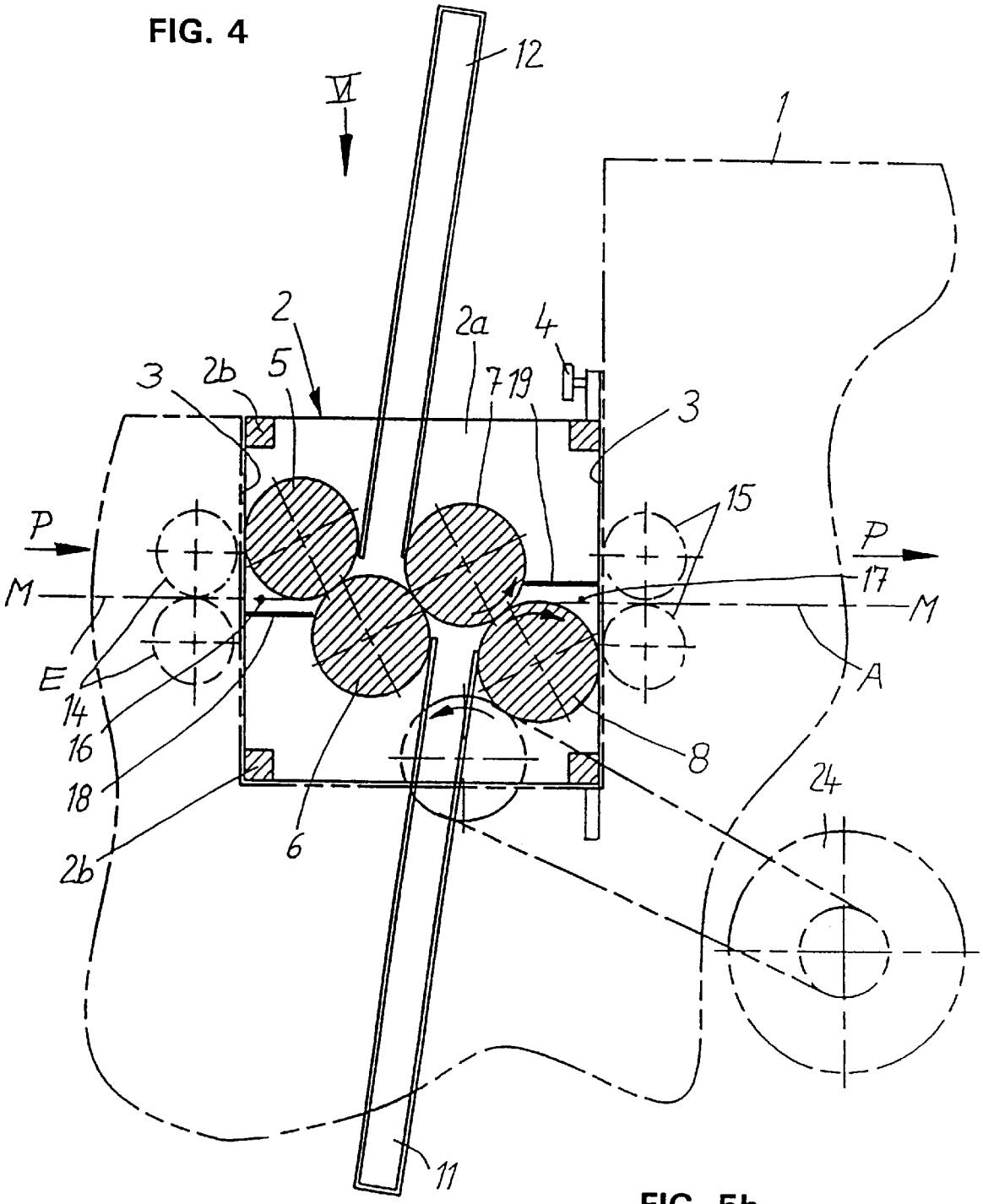
FIG. 5a
FIG. 5b
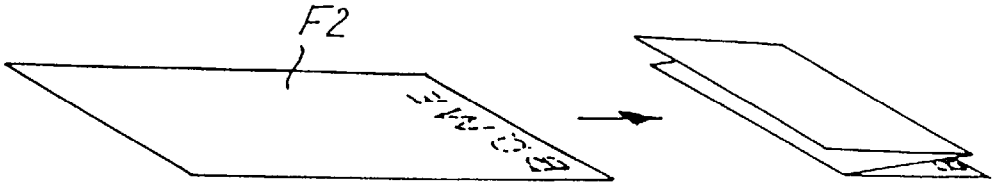

BUCKLE FOLDING MECHANISM WITH TWO OR THREE FOLDING POCKETS

FIELD OF THE INVENTION

This invention relates to a buckle folding mechanism with two or three folding pockets, a plurality of folding rollers, which are mounted in a folding mechanism block detachable from the machine frame, and with a drive arranged outside the folding mechanism block, wherein the folding mechanism block comprises a sheet input on one of its sides and a sheet output on its opposite side and wherein the sheets are fed to the folding mechanism block via transport devices along an input plane in the paper feed direction and are transported away along an outlet plane in the same direction.

BACKGROUND OF THE INVENTION

In the usual buckle folding mechanisms with two folding pockets the folding pockets are fixedly installed in the paper feed direction. Two arrangements of the folding pockets are possible, namely with the first folding pocket, in the paper feed direction, below and the second folding pocket above or vice versa. There are different folding possibilities, depending on whether the first folding pocket is below or above. If such folding mechanisms with two folding pockets are fitted on envelope stuffing machines or similar machines, the form must have a specific position after leaving the folding mechanism. If for example the envelope stuffing machine positions the envelope with the window lying upwards, the form must be so folded that the address is on top following the folding mechanism, since an additional device would otherwise be necessary to turn the form over. In order to overcome this problem it would indeed be possible to use a buckle folding mechanism which has one folding pocket and one pair of folding rollers more than folds are needed in the form in question, i.e. a buckle folding mechanism with three folding pockets for folding a form with two folds and a buckle folding mechanism with four folding pockets for folding a form with three folds. One of the folding pockets can be switched out of action in each case by suitable deflectors and the form be so folded that the address lies selectively on top or underneath following the folding mechanism. However additional expense and sources of error arise from the greater number of folding pockets, and also cycle time losses through the increase in the path of travel.

In one known buckle folding mechanism of the kind referred to initially (DE 2 459 294 C2, FIG. 3) the folding mechanism block consists of a driving block and a folding mechanism head, with the folding rollers and the folding pockets, fitted thereon and attached interchangeably. The sheet inlet and the sheet outlet are arranged at different heights in the folding mechanism head, as are the inlet and the outlet planes. The folding mechanism head can be interchanged with other folding mechanism heads with differing constructions and differing layouts, so that it would here also be possible to replace a folding mechanism head whose first folding pocket lay below with another with a first folding pocket lying above. However two different folding mechanism heads would be needed in this case, whereby the manufacturing costs and servicing costs of the buckle folding mechanism increase and space has to be provided to store the unused folding mechanism head.

A paper folding machine is further known (DE-PS 517 549) in which one of the folding rollers is movably mounted, so that it can cooperate selectively with two different other folding rollers and in which one of the folding pockets can moreover be changed from one side of the machine to the other. It is indeed possible to produce oppositely directed folds selectively through this but the sheet outlet lies either on the inlet side of the sheet or on the side opposite the inlet side, depending on the position of the movable folding roller and the interchangeable folding pocket. However the result of this is that the transport device with which the folded sheet is transported away must be arranged on different sides of the buckle folding mechanism, depending on the folding direction, which would in practice require substantial setting up work or would actually not be possible, because the various operating and feed assemblies which follow the buckle folding mechanism cannot be brought simply out of their original arrangement into one directed the other way.

SUMMARY OF THE INVENTION

The invention is therefore based on the object of providing a buckle folding mechanism with two or three folding pockets, of the kind initially recited, which can be produced cost-effectively and can be so changed over with a small amount of work that the initially mentioned different folds can be carried out therewith.

This is achieved according to the invention in that the inlet plane and the outlet plane of the transport devices are arranged substantially in a common plane, in that the folding rollers and folding pockets are so arranged in the folding mechanism block that the sheet inlet and the sheet outlet also lie in the region of this common plane in the existing installed position of the folding mechanism block in the machine frame, in that all folding rollers are drivably coupled together in the folding mechanism block by coupling gearwheels which are arranged on one end of each folding roller, in that the drive is arranged in the machine frame and comprises a driving gearwheel which is mounted in the region of the folding mechanism block in the machine frame and meshes with one of the coupling gearwheels in a first installed position of the folding mechanism block, and in that one of the folding rollers carries on its other end a driven gearwheel which meshes with the driving gearwheel in a second installed position of the folding mechanism block, in which this is fitted in the machine frame rotated relative to its first installed position through 180° about a conceptual axis running parallel to the paper feed direction.

The invention is thus based on the idea of fitting one and the same folding mechanism block in the machine frame in two different installed positions rotated through 180° relative to one another. Because of this the first folding pocket as regarded in the paper feed direction is below and the second folding pocket above in a first installed position and in a second installed position of the folding mechanism block the first folding pocket is above and the second folding pocket is below, whereby different foldings of the paper sheet or form can be created depending on the installed position of the folding mechanism block. However, since the sheet inlet and sheet outlet of the folding mechanism block are arranged in the same common plane as the inlet plane and the outlet plane, regardless of the current installed position, it is not necessary to adjust the transport devices preceding and following the buckle folding mechanism when the folding mechanism block is placed in its two installed positions rotated through 180° in the machine frame. The sole changeover feature consists in detaching the folding mechanism block from the machine frame, turning it through 180° , fitting it in the machine frame again and screwing it in there. Since the driving gearwheel mounted in the machine frame meshes either with one of the coupling gearwheels or with the driven gearwheel disposed on the other side of the folding mechanism block, depending on the installed position, no further fitting work is necessary to couple the drive to one of the folding rollers. Since four folding rollers are provided in a buckle folding mechanism with two pockets, the driven gearwheel can be so associated with one of these four gearwheels that reversal of the direction of rotation of the drive motor is not necessary in order to drive the folding rollers in the correct direction of rotation, regardless of the current installed position.

In a further arrangement of the invention the machine frame comprises positioning devices, by means of which the folding mechanism block can be so positioned relative to the machine frame in both of its installed positions that the sheet inlet and sheet outlet lie in the common plane and the driving gearwheel meshes alternatively with one of the coupling gearwheels or the driven gearwheel. The necessary conversion time can be substantially shortened by such a positioning device, which can be formed by a suitable guide system, since it only then necessary, in order to convert the folding mechanism block from its one installed position to its other installed position, to release a few retaining screws, take the folding mechanism block out of the positioning means, turn the folding mechanism block through 180°, fit it in the positioning devices again and tighten up the retaining screws. Further changes, such as adapting to the transport devices, coupling to the drive device, connection to safety switches and the like are not necessary.

BRIEF DESCRIPTION OF THE DRAWINGS

The invention will be explained in more detail below with reference to embodiments shown in the drawings, in which:

FIG. 4 is a longitudinal section with a second installed position of the folding mechanism block, FIGS. 5*a* and 5*b* show how a form can be processed with this installed position.

DETAILED DESCRIPTION

Figure 1:
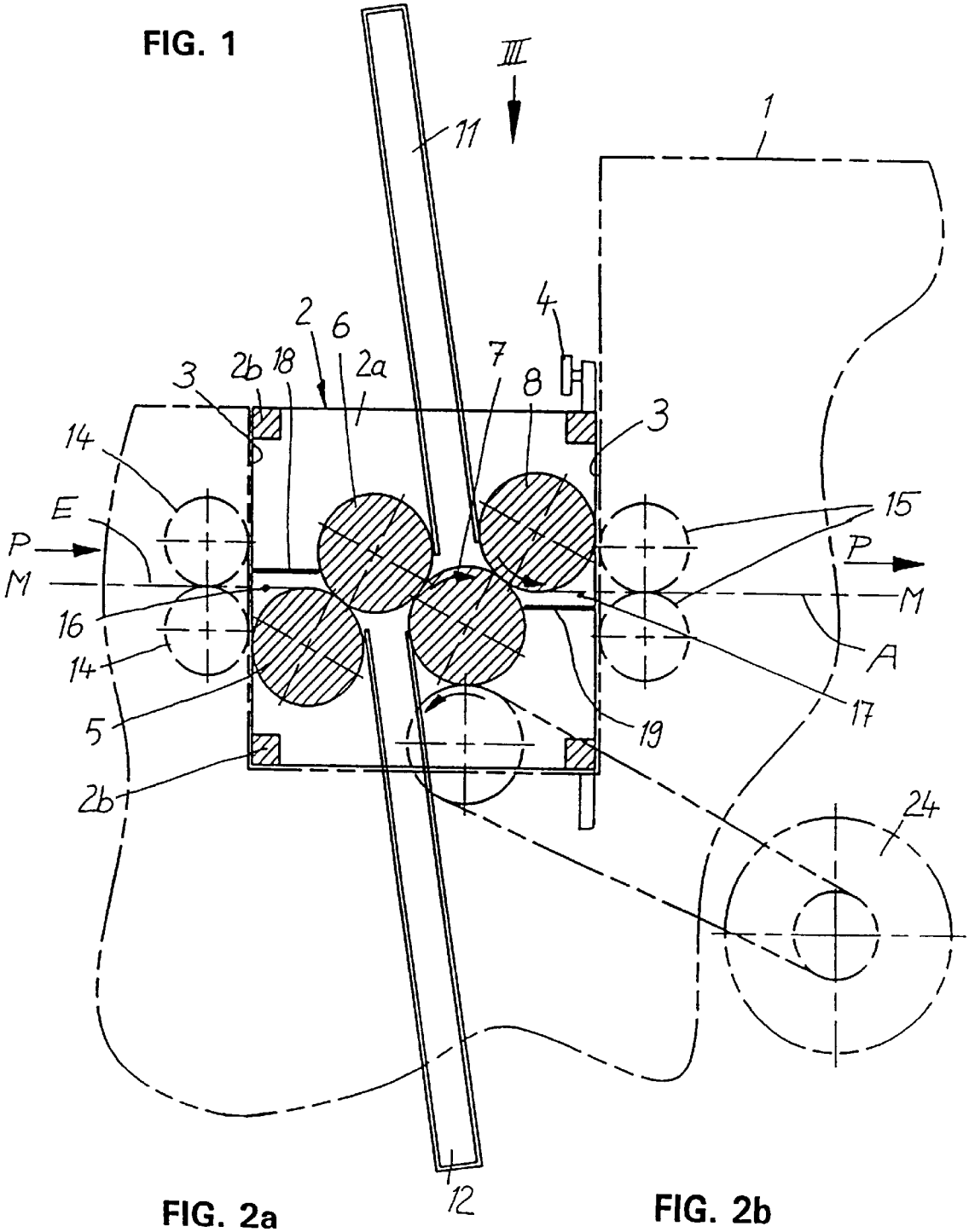
FIG. 1 is a longitudinal section of the buckle folding mechanism in a schematic representation, with the folding mechanism block in a first installed position.

The buckle folding mechanism comprises a machine frame 1 and a folding mechanism block 2 which can be detached from the frame. A positioning device in the form of guides 3, into which the folding mechanism block can be inserted from above, is advantageously provided to retain and position the folding mechanism block 2 relative to the machine frame. Screws 4 can be provided in order to fix the folding mechanism block 2 in the machine frame 1. The folding mechanism block 2 has side bearing plates 2*a*, which are connected together by crosspieces 2*b*. A plurality of folding rollers 5–8 are rotatably mounted in the folding mechanism block. In the embodiment shown in FIGS. 7 and 8 a further folding roller 9 is provided. In the embodiment shown in FIGS. 1–6 the folding mechanism block 2 has two folding pockets 11, 12 while a third folding pocket 13 is further provided in the embodiment shown in FIGS. 7 and 8. A transport device, indicated by way of example as two transport rollers 14, is provided ahead of the folding mechanism block and the paper sheets, e.g. printed forms F1 or F2 (see FIGS. 2*a* and 5*a*) to be folded are fed by this device along an inlet plane E to the folding mechanism block. Following the folding mechanism block 2 there is provided a further transport device, which is indicated by rollers 15, with which the folded forms are further transported along an outlet plane A. The inlet plane E and outlet plane A are disposed substantially in a common plane M—M. The folding rollers 5–8 or 5–9 and the folding pockets 11, 12 or 11–13 are so arranged in the folding mechanism block 2 that their sheet inlet 16 and their sheet outlet 17 lie in the region of this common plane M—M in the current installed position of the folding mechanism 2. Guide plates 18, 19 are further provided at the sheet inlet 16 and sheet outlet 17 respectively. The paper feed direction is shown by the arrows P.

Figure 3:
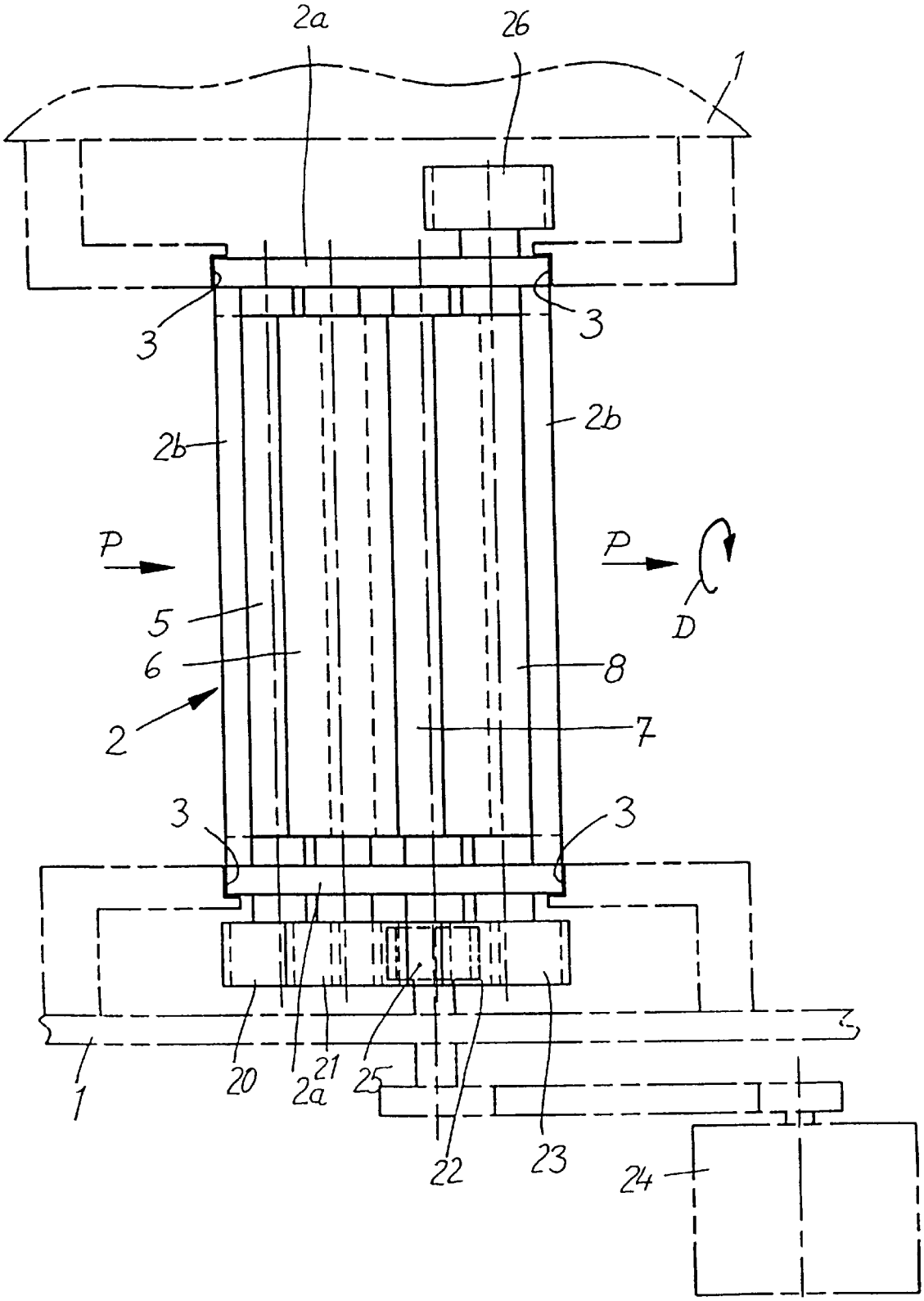
FIG. 3 is a plan view in the direction III of FIG. 1 with the upper folding pocket omitted.
Figure 6:
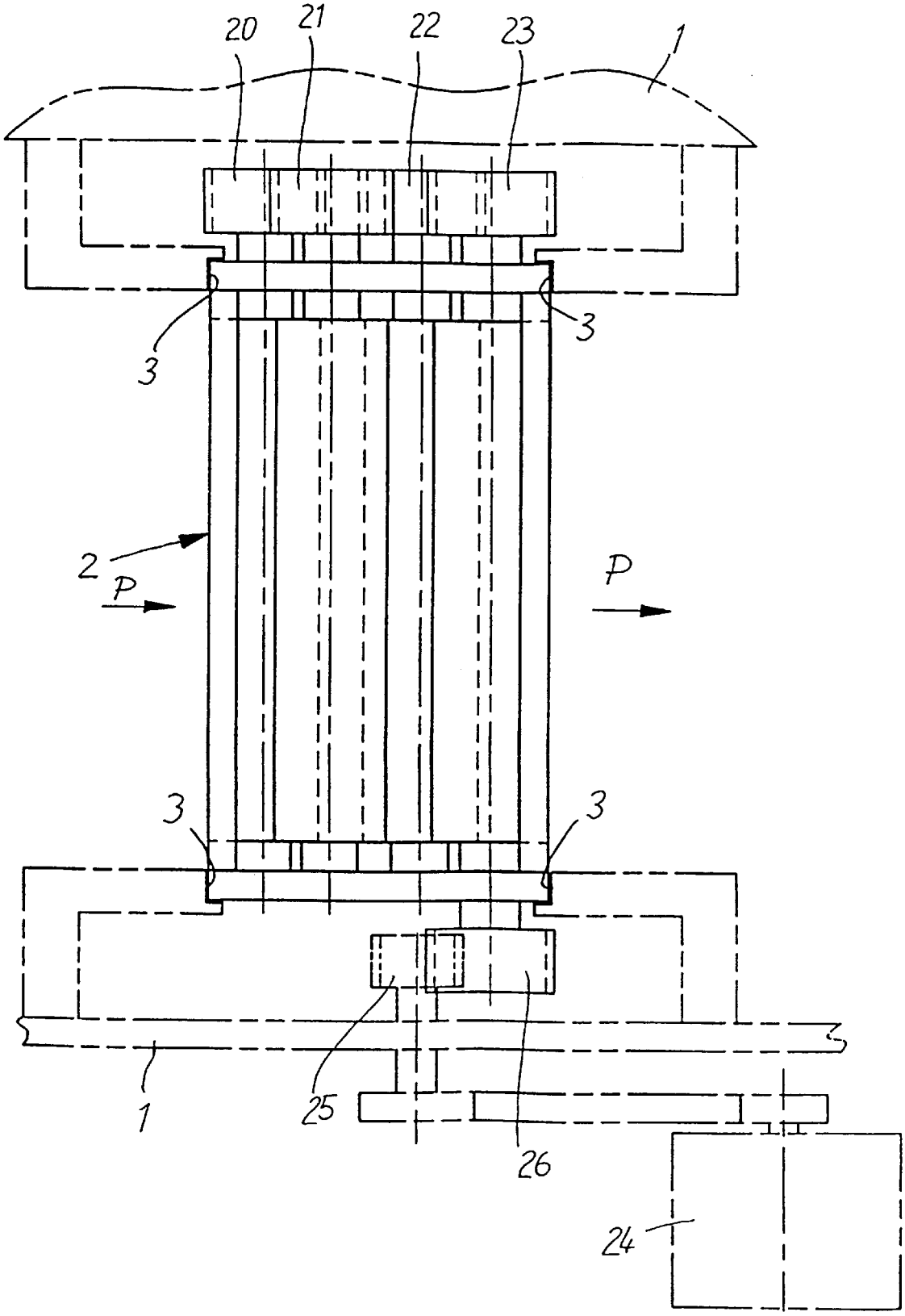
FIG. 6 is plan view in the direction VI of FIG. 4 with the upper folding pocket omitted.

It can be seen from FIGS. 3 and 6 that in each case a coupling gearwheel 20–23 is disposed on one end of each folding roller 5–8. The coupling gearwheels 20–23 mesh with one another, whereby all four folding rollers 5–8 are drivably connected together. The same applies in relation to the further folding rollers 9, 10 in the embodiment shown in FIGS. 7 and 8.

A drive motor 24 is further arranged in the machine frame 1 and drives a driving gearwheel 25 mounted in the machine frame 1. In the first installed position of the folding mechanism block 2 shown in FIGS. 1 and 3, this driving gearwheel 25 meshes with one of the coupling gearwheels, namely the coupling gearwheel 22, which is associated with the folding roller 7. The folding rollers 5–8 are thus driven in the directions of rotation shown in FIG. 1 by arrows.

The folding roller 8 has a driven roller 26 at its other end, which engages with the driving gearwheel 25 in the second installed position of the folding mechanism block 2, as is shown in FIGS. 4 and 6. The folding rollers are accordingly driven in the directions indicated by the arrows according to FIG. 4, without the direction of rotation of the drive motor 24 being changed. The man skilled in the art can readily find that folding roller with which the driving gearwheel 26 must be associated in order that the direction of rotation of the drive motor 24 can be retained in the two installed positions of the folding mechanism block. Thus the driven gearwheel can also be associated with the folding roller 6 in the described embodiment if the driving gearwheel 25 is so arranged that is meshes with the coupling gearwheel 22 in the first installed position and with the driven gearwheel then associated with the folding roller 6 in the second installed position of the folding mechanism block 2.

Figure 2A:
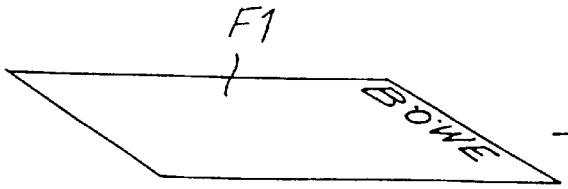
FIGS. 2*a* and 2*b* show how a form can be processed with this installed position.
Figure 2B:
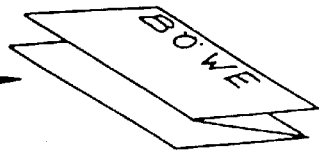

With reference to FIGS. 2*a* and 2*b* there is shown how a form F1 on which the address is disposed on top can be so folded by means of the buckle folding mechanism according to the invention that the address is likewise on top in the folded form, according to FIG. 2*b*. To this end the folding mechanism block 2 is mounted in its first installed position in the machine frame 1 shown in FIGS. 1 and 3.

If in contrast a form F2 according to FIG. 5*a* with an address facing down is to be folded, then the retaining screws 4 are released and the folding mechanism block is withdrawn upwardly from the guides 3 of the machine frame 1. It is then turned through 180° about a conceptual axis parallel to the paper feed direction P, as is shown in FIG. 3 by the arrow D. After turning through 180° the folding mechanism block 2 is inserted into the guides 3 again and the retaining screws 4 are tightened. The whole changeover operation is finished with this.

As can be seen with reference to FIG. 4, the folding pocket 12 of the folding mechanism block 2 which is first in the paper feed direction P is now directed upwardly and the second folding pocket 11 downwardly. The sheet inlet 16 formed between the folding roller 5 and the guide plate 18 and also the sheet outlet 17 formed between the folding roller 8 and the guide plate 19 also lie in the region of the common plane M—M in the position of the folding mechanism block 2 turned through 180°. The paper sheets or forms fed from the transport device 14 along the inlet plane E can thus also pass in the second installed position of the folding mechanism block 2 into its sheet inlet 16, without a height adjustment of the transport device 14 being necessary. The same applies also to the transport device 15, which further transports the folded paper sheet or form emerging from the sheet outlet 17 in the paper feed direction P. With the folding mechanism block mounted in the second position in the machine frame 1, paper sheets or forms F2, in which the address is now facing downwards in accordance with FIG. 5*a* can be so folded according to FIGS. 5*a* and 5*b* that the address also faces downwardly after the folding according to FIG. 5*b* in the folded sheet.

Figure 7:
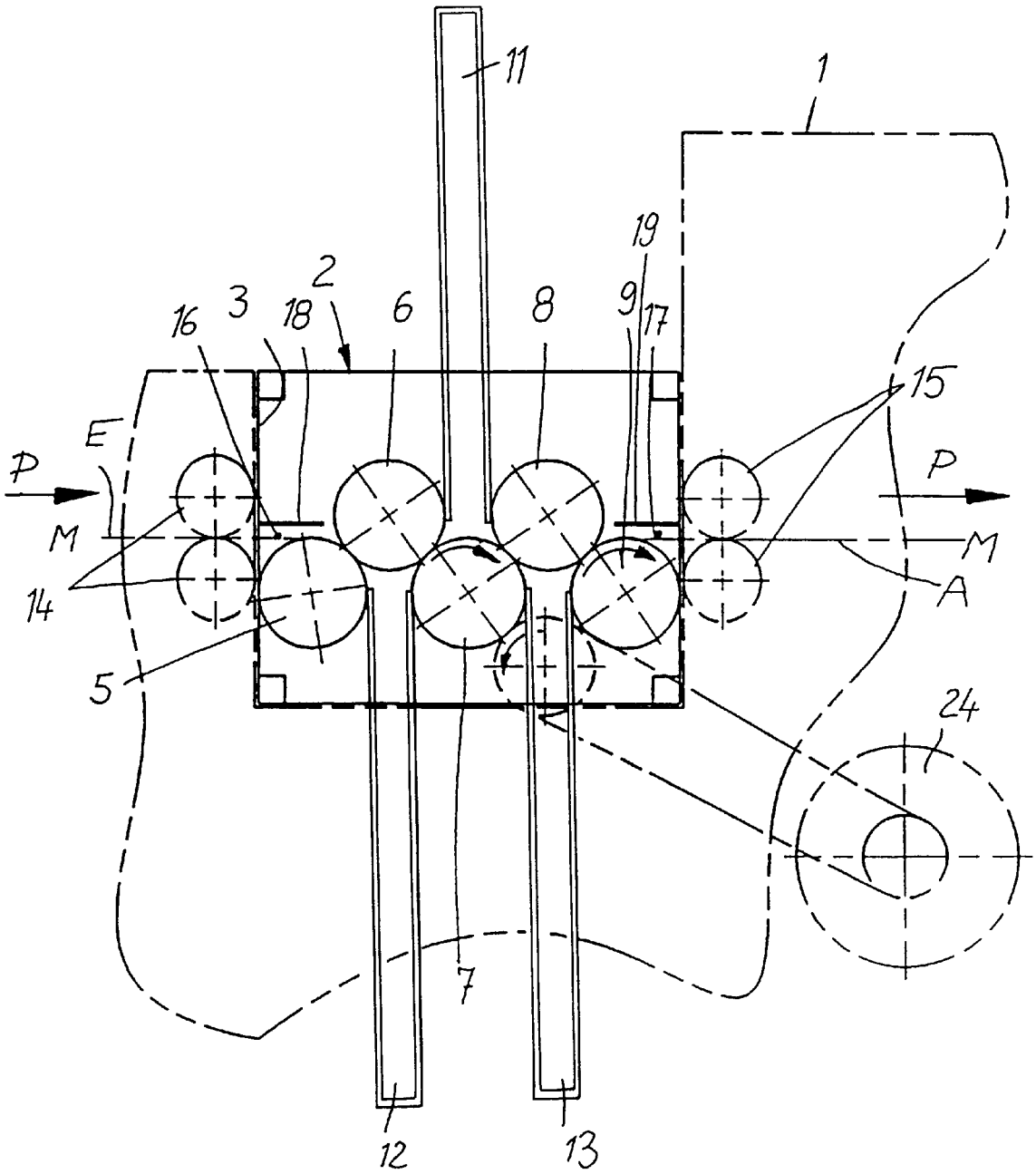
FIGS. 7 and 8 are longitudinal sections of a second embodiment of a buckle folding mechanism with three folding pockets and two different installed positions of the folding mechanism block.
Figure 8:
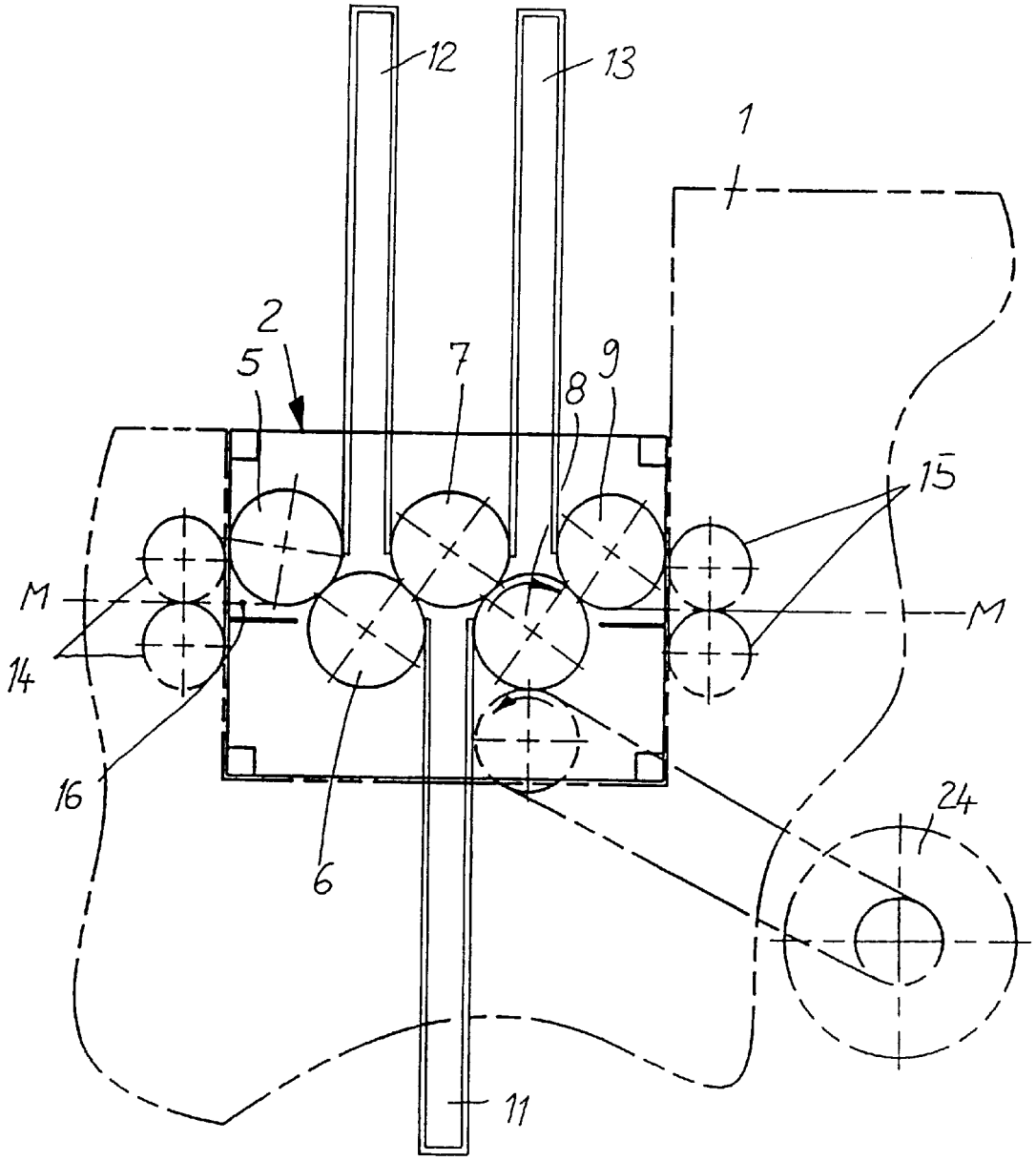

The previous description applies in general also to the buckle folding mechanism shown in FIGS. 7 and 8, which is provided with three folding pockets 11, 12, 13, so that repeated description is superfluous. Sheets of paper or forms can be given three folds with the buckle folding mechanism shown in FIGS. 7 and 8, wherein the address or special printing is also directed to the same side after the folding as before the folding, depending on the installed position of the folding mechanism block.

The folding mechanism block could if desired also be turned through 180° about a conceptual axis running transverse to the common plane, in order to bring it from one installed position into its other installed position. However the driven gearwheel then has to be associated with another folding roller.

What is claimed is:

1. A buckle folding mechanism with two or three folding pockets, comprising a plurality of folding rollers mounted in a folding mechanism block detachable from a machine frame, and a drive arranged outside the folding mechanism block, wherein the folding mechanism block comprises a sheet input on one of its sides and a sheet output on its opposite side and wherein the sheets are fed to the folding mechanism block via transport devices along an input plane in a paper feed direction and are transported away along an outlet plane in the same direction, wherein the inlet plane and the outlet plane of the transport devices are arranged substantially in a common plane, the folding rollers and folding pockets are so arranged in the folding mechanism block that the sheet inlet and the sheet outlet also lie in a region of the common plane in the existing installed position of the folding mechanism block in the machine frame, wherein all folding rollers are drivably coupled together in the folding mechanism block by coupling gearwheels arranged on one end of each of the folding rollers, the drive is arranged in the machine frame and comprises a driving gearwheel which is mounted in the region of the folding mechanism block in the machine frame and meshes with one of the coupling gearwheels in a first installed position of the folding mechanism block, and one of the folding rollers carries on its other end a driven gearwheel which meshes with the driving gearwheel in a second installed position of the folding mechanism block, at which the folding mechanism block is fitted in the machine frame rotated relative to its first installed position through 180° about a conceptual axis running parallel to the paper feed direction.

2. A buckle folding mechanism according to claim 1, wherein the machine frame comprises positioning devices for retaining and positioning the folding mechanism block relative to the machine frame in both of its installed positions.

3. A buckle folding mechanism with two or three folding pockets, comprising:

a machine frame;

a folding mechanism block installed in and detachable from the machine frame, comprising:

a plurality of folding rollers mounted therein, a first generally upwardly and outwardly extending folding pocket in a first installed position;

a second generally downwardly and outwardly extending folding pocket in the first installed position; and a sheet input on one side and a sheet output on an opposing side thereof;

a first transport device for feeding sheets to the input of the folding mechanism block along an input plane; and a second transport device for transporting sheets received from the sheet output of folding mechanism block along an outlet plane;

wherein the folding mechanism block is moved to a second installed position by rotating the folding mechanism block relative to its first installed position through 180 degrees about a conceptual axis running parallel to a paper feed direction, the first generally upwardly and outwardly extending folding pocket extending downwardly and outwardly in the second installed position and the second generally downwardly and outwardly extending folding pocket extending upwardly and outwardly in the second installed position.

4. The buckle folding mechanism of claim 3, wherein the sheet input and the sheet output of the folding mechanism block and the inlet plane and outlet plane of the first and second transport devices lie in a substantially common plane in the first installed position and in the second installed position.

5. The buckle folding mechanism according to claim 3, wherein the machine frame comprises positioning devices for retaining and positioning the folding mechanism block relative to the machine frame in both the first installed position and the second installed position.

6. The buckle folding mechanism according to claim 3, wherein the folding rollers are drivably coupled together in the folding mechanism block by coupling gearwheels that are arranged on one end of each of the folding rollers.

7. The buckle folding mechanism according to claim 6, wherein a drive is arranged in the machine frame and comprises a driving gearwheel which is mounted in a region of the folding mechanism block in the machine frame and meshes with one of the coupling gearwheels in the first installed position of the folding mechanism block.

8. A buckle folding mechanism with two or three folding pockets, comprising:

a machine frame;

a folding mechanism block installed in and detachable from the machine frame, the folding mechanism block including a plurality of folding rollers mounted therein, folding pockets, a sheet input on one side and a sheet output on an opposing side;

a drive arranged in the machine frame outside the folding mechanism block;

transportation devices for feeding sheets to the folding mechanism block along an input plane in a paper feed direction and transporting away sheets along an outlet plane in the same direction;

wherein the inlet plane and the outlet plane of the transport devices are arranged substantially in a common plane, and the sheet input and the sheet output also lie in a region of the common plane in both a first installed position and a second installed position at which the folding mechanism block is rotated relative to the first installed position through 180 degrees about a conceptual axis running parallel to the paper feed direction.

9. The buckle folding mechanism of claim 8, further comprising:

coupling gearwheels which are arranged on one end of each of the folding rollers so that the folding rollers are drivably coupled together in the folding mechanism block;

a driving gearwheel mounted in a region of the folding mechanism block in the machine frame that meshes with one of the coupling gearwheels, which comprises a driven gearwheel in the first installed position of the folding mechanism block and meshes with the other end of the driven gearwheel in the second installed position of the folding mechanism block, the drive powering the driving gearwheel.

10. The buckle folding mechanism according to claim 8, wherein the machine frame comprises positioning devices for retaining and positioning the folding mechanism block relative to the machine frame in both the first installed position and the second installed position.

11. The buckle folding mechanism according to claim 8, wherein the folding rollers are drivably coupled together in the folding mechanism block by coupling gearwheels.

* * * * *